US010012373B2

(12) United States Patent
Zieder

(10) Patent No.: US 10,012,373 B2
(45) Date of Patent: Jul. 3, 2018

(54) MOUNTING BASE FOR AN ELECTRICAL COMPONENT HAVING A HOUSING WITH A GROOVE WITH A CONVERGENT BOTTOM FOR CRIMPING AN ELECTRICAL WIRE

(71) Applicant: IDZ CONCEPT, Douvaine (FR)

(72) Inventor: David Zieder, Sciez sur Leman (FR)

(73) Assignee: IDZ CONCEPT, Douvaine (FR)

( * ) Notice: Subject to any disclaimer, the term of this patent is extended or adjusted under 35 U.S.C. 154(b) by 0 days.

(21) Appl. No.: 15/323,298

(22) PCT Filed: Jul. 3, 2015

(86) PCT No.: PCT/EP2015/065170
§ 371 (c)(1),
(2) Date: Dec. 30, 2016

(87) PCT Pub. No.: WO2016/001395
PCT Pub. Date: Jan. 7, 2016

(65) Prior Publication Data

US 2017/0191648 A1 Jul. 6, 2017

(30) Foreign Application Priority Data

Jul. 4, 2014 (FR) ..... 14 56476

(51) Int. Cl.
*H01R 24/00* (2011.01)
*F21V 23/06* (2006.01)
(Continued)

(52) U.S. Cl.
CPC ..... *F21V 23/06* (2013.01); *A41D 1/005* (2013.01); *F21V 23/001* (2013.01);
(Continued)

(58) Field of Classification Search
CPC ..... H01R 24/00; H01R 33/09; H01R 4/2416; H01R 4/2454; H01R 4/2462; H01R 4/245;
(Continued)

(56) References Cited

U.S. PATENT DOCUMENTS 5,829,865 A * 11/1998 Ahroni ..... F21V 21/002 362/249.01
5,934,929 A 8/1999 Saka et al.
(Continued)

FOREIGN PATENT DOCUMENTS

EP 0692850 A2 1/1996
JP 2004-311133 A 11/2004
(Continued)

OTHER PUBLICATIONS

English translation of the incoming written opinion PCT/EP2015/065170 filed Jul. 3, 2015.*
(Continued)

*Primary Examiner* — Chandrika Prasad
(74) *Attorney, Agent, or Firm* — Oblon, McClelland, Maier & Neustadt, L.L.P.

(57) ABSTRACT

A base for a wired electrical component, including: a cavity receiving the electrical component including at least one electrical crimp contact; and at least one groove configured to receive an electrical wire to be connected to the electrical component. The at least one groove includes, in a transverse cross-section: a portion shaped to receive an electrical wire; and a converging base acting as a crimping die when the electrical crimp contact is inserted in the groove. A lighting module includes such a base, a method creates and mounts, on a corresponding mounting, a module including such a base, and a garment includes at least one module that includes such a base.

22 Claims, 9 Drawing Sheets

Figure 1:
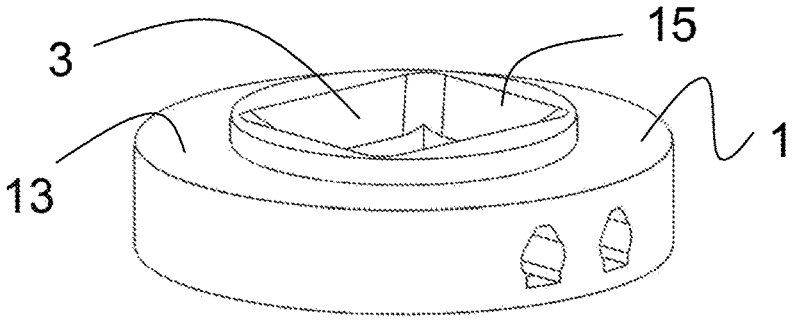

(51) Int. Cl.

| | |
|---|---|
| ***H01R 4/18*** | (2006.01) |
| ***F21V 23/00*** | (2015.01) |
| ***F21V 33/00*** | (2006.01) |
| ***A41D 1/00*** | (2018.01) |
| ***H01R 33/09*** | (2006.01) |
| *F21Y 115/10* | (2016.01) |

(52) U.S. Cl.
CPC ..... *F21V 33/0008* (2013.01); *H01R 4/18* (2013.01); *H01R 33/09* (2013.01); *F21Y 2115/10* (2016.08)

(58) Field of Classification Search
CPC ..... H01R 4/18; H01R 4/185; H01R 4/188; H01R 13/28; A41D 1/005; F21V 23/06; F21V 23/001; F21V 33/0008
USPC .... 439/620.24, 375, 395, 404; 362/654, 657
See application file for complete search history.

(56) References Cited

U.S. PATENT DOCUMENTS

| | | | | |
|---|---|---|---|---|
| 6,168,456 | B1 | 1/2001 | Saka et al. | |
| 6,261,119 | B1 * | 7/2001 | Green | H01R 4/2408 439/411 |
| 6,328,593 | B1 * | 12/2001 | Chang | F21V 21/002 362/249.01 |
| 7,422,489 | B1 * | 9/2008 | Tseng | H01R 33/09 362/654 |
| 7,575,362 | B1 * | 8/2009 | Hsu | H01R 33/09 362/647 |
| 8,853,721 | B2 * | 10/2014 | Chen | H01L 23/495 257/100 |
| 2008/0268718 | A1 | 10/2008 | Cox et al. | |
| 2009/0197451 | A1 | 8/2009 | Cox et al. | |
| 2011/0215368 | A1 | 9/2011 | Chen | |
| 2011/0286223 | A1 | 11/2011 | Chen | |
| 2011/0303939 | A1 | 12/2011 | Chen | |
| 2011/0305022 | A1 | 12/2011 | Chen | |

FOREIGN PATENT DOCUMENTS

| | | |
|---|---|---|
| JP | 2008-300884 A | 12/2008 |
| WO | 2009/025078 A1 | 2/2009 |

OTHER PUBLICATIONS

International Search Report dated Dec. 14, 2015, in PCT/EP2015/065170, filed Jul. 3, 2015.

* cited by examiner

FIG. 6
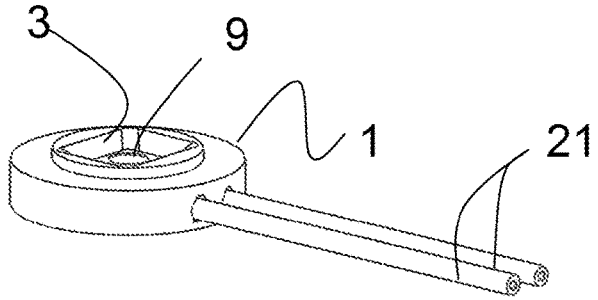
FIG. 7
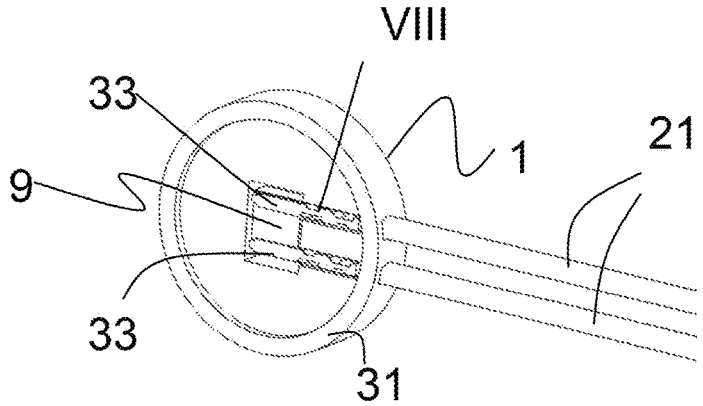
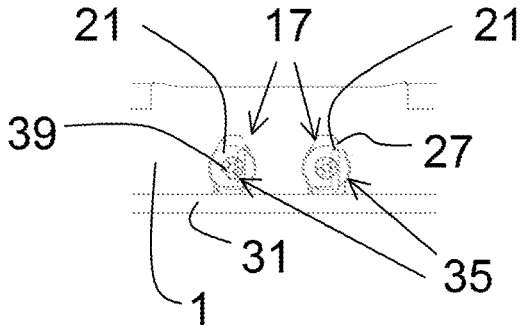
FIG. 8

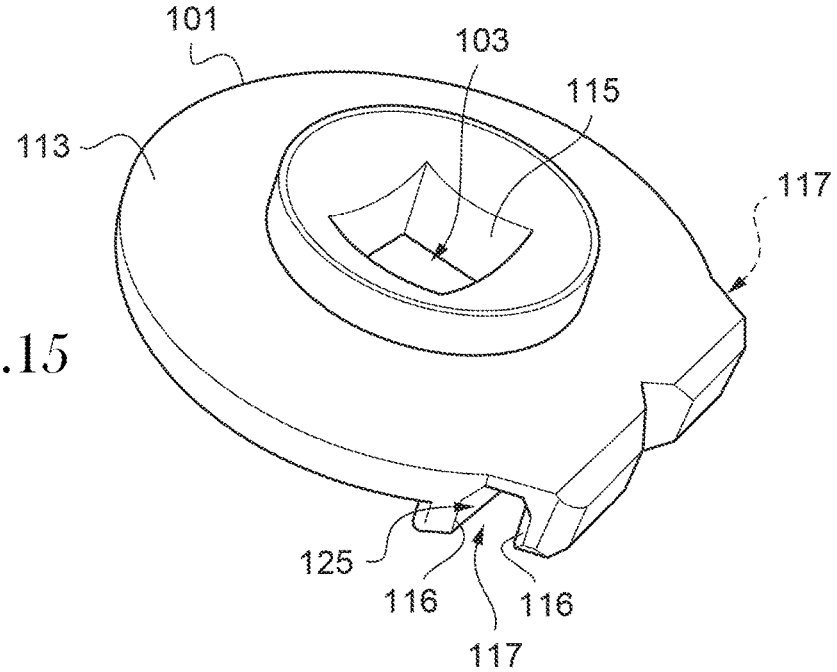
Fig.15
Fig.16
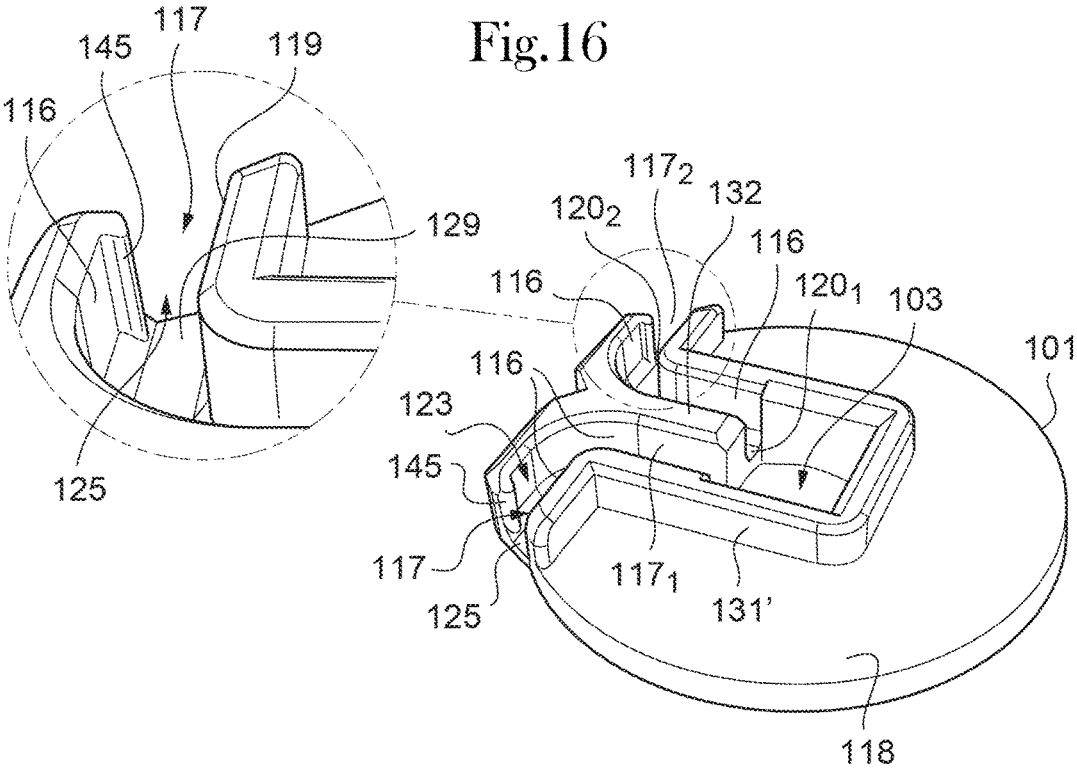

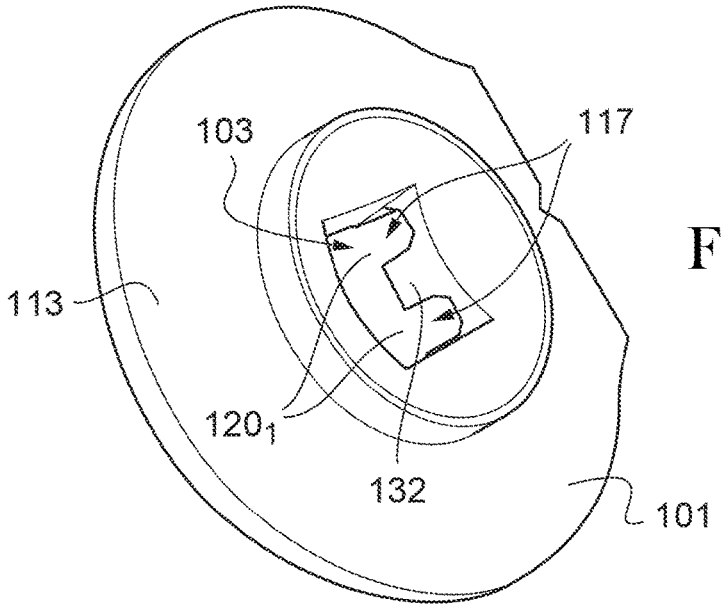
Fig.17
Fig.18
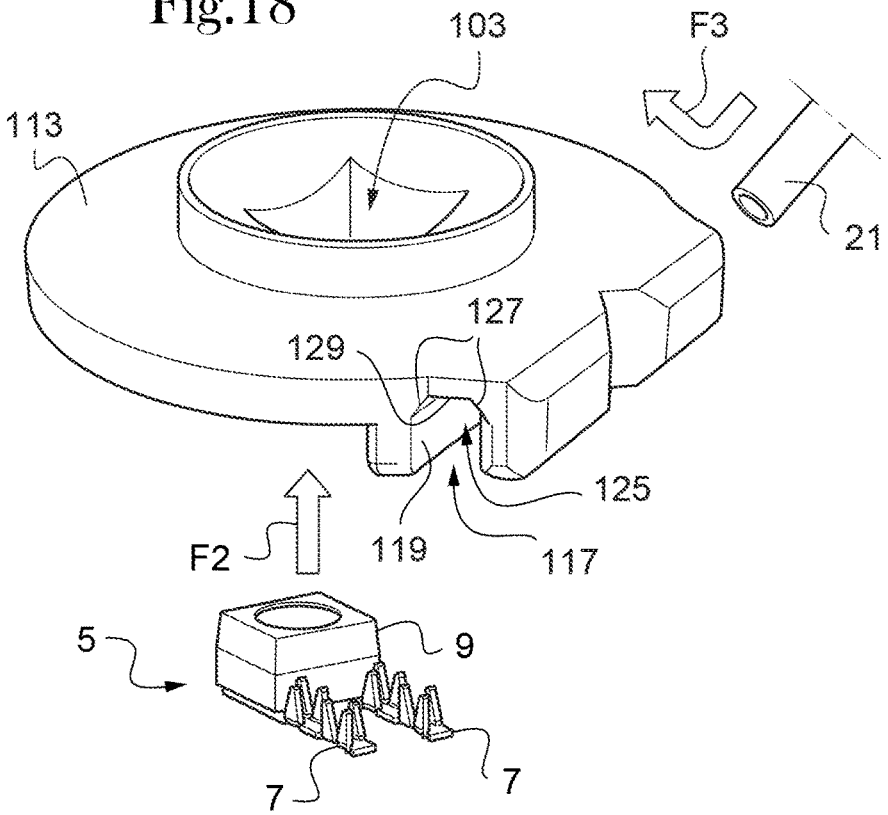

Fig.19
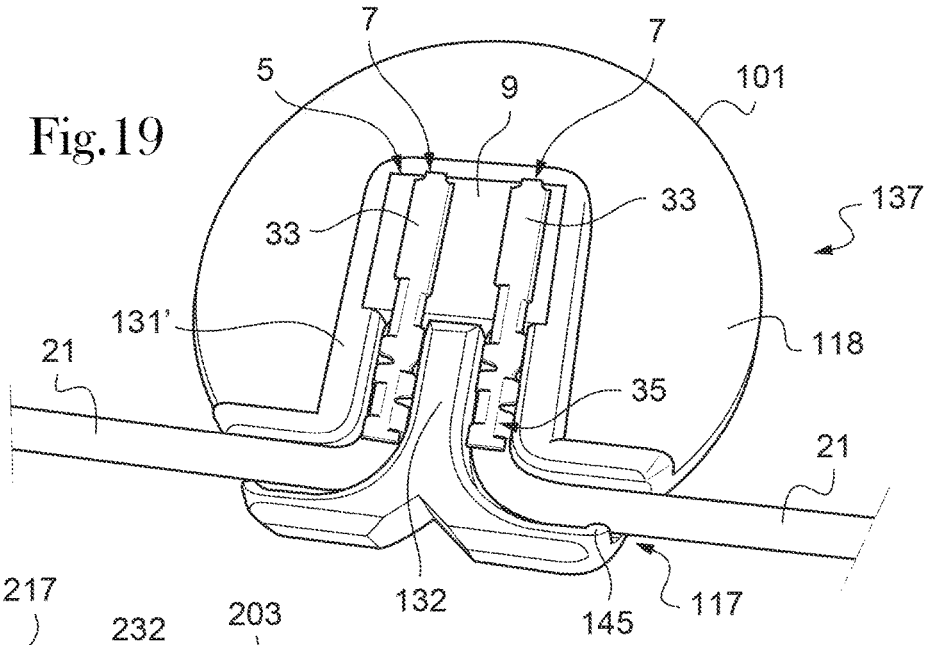
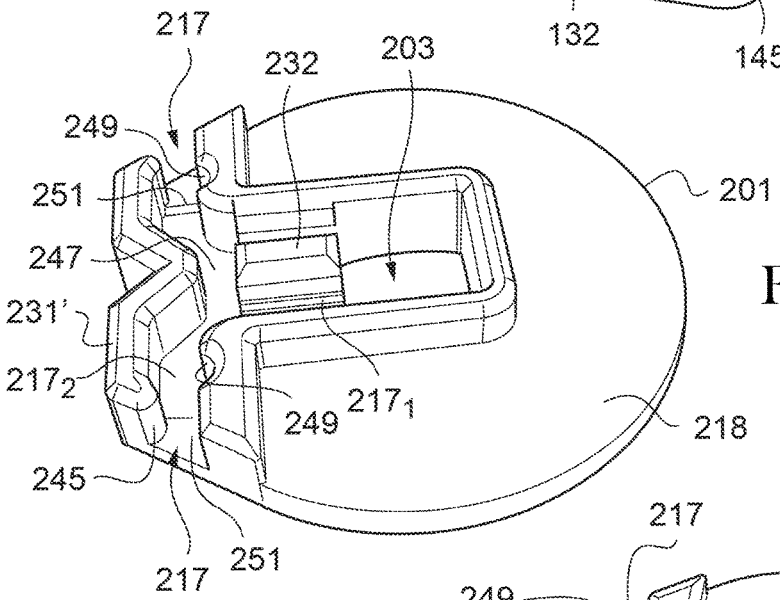
Fig.20
Fig.21
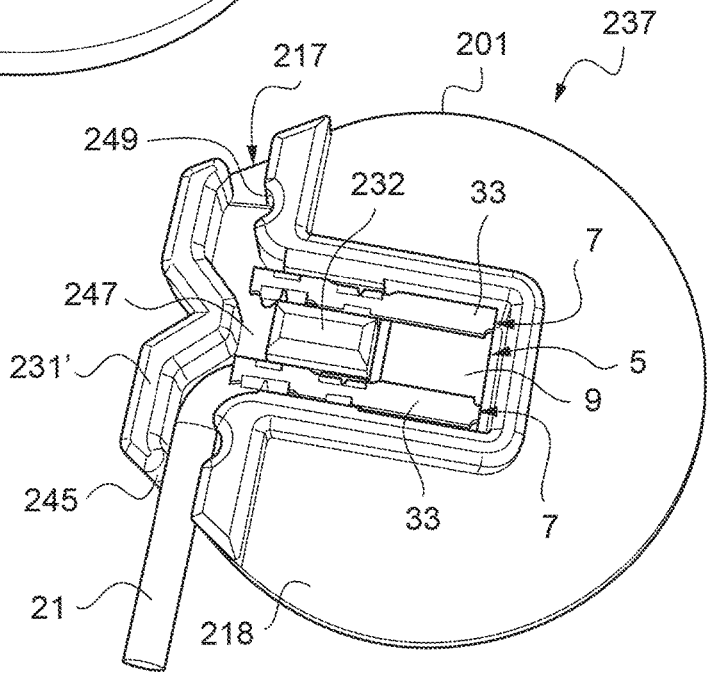

MOUNTING BASE FOR AN ELECTRICAL COMPONENT HAVING A HOUSING WITH A GROOVE WITH A CONVERGENT BOTTOM FOR CRIMPING AN ELECTRICAL WIRE

The present invention relates to a mounting base for a wired electrical component.

The invention also relates to a lighting module comprising such a mounting base and an electrical component such as a light emitting diode.

The invention also relates to a method for producing a module comprising such a mounting base and to a garment comprising at least one such module.

Nowadays, there are numerous electrical components, notably of small size, which need to be connected in a simple way to an electrical circuit, notably a power or control circuit.

To do this, the component is generally mounted in a casing or on its support and the electrical wires are welded by hand or automatically in order to electrically connect the component.

However, this solution is painstaking and expensive, and the smaller the component is, the more difficult it becomes to make these soldered connections.

In the field of connections, solderless connections, particularly crimped connections for example are known (see for example FR2956780). These generally involve connecting a ribbon of electrical wires to a connector. To do this, electrical contacts or plugs are produced, with a male end for example being held in a connector casing and with the other end having crimping spikes which pass through the cable in order to make the electrical connection. The crimping spikes also close around the cables in order to afford mechanical retention between the electrical wire and the electrical plug.

The crimping operation has in general to be performed using special-purpose crimping pliers, and this limits its scope of use. Thus, there is no specific tool available for connecting for example a single electrical wire using crimping.

It is an objective of the invention to at least partially alleviate the aforementioned deficiencies.

To this end, one subject of the invention is a mounting base for a wired electrical component comprising:

- a housing to receive the electrical component equipped with at least one crimping electrical contact, and
- at least one groove able to receive an electrical wire intended to be connected to the electrical component, characterized in that said at least one groove has in cross section:

- a portion configured to receive an electrical wire, and
- a convergent bottom acting as a crimping shape when the crimping electrical contact is inserted into the groove.

Thus, wiring can be done easily and reliably without the need to use a special-purpose tool such as crimping pliers. Specifically, all that is required is for the electrical component equipped with one or more crimping electrical contacts to be assembled with the mounting base in such a way that the crimping elements such as spikes belonging to the or each crimping electrical contact deform as they encounter the convergent bottom of an associated groove belonging to the mounting base.

According to one aspect of the invention, said at least one groove has an access canal for the crimping electrical contact, the access canal being arranged opposite to the convergent bottom.

Advantageously, the access canal is oriented substantially perpendicular to the overall plane defined by the mounting base.

According to one embodiment of the invention, said at least one groove extends along a longitudinal axis and has, in cross section:

- the portion configured to receive an electrical wire having a maximum width,
- the access canal for the crimping electrical contact oriented substantially perpendicular to the axis of the groove and having a width smaller than the maximum width of the portion configured to receive an electrical wire, and
- the convergent bottom opposite to the access canal.

The portion configured to receive an electrical wire is for example of substantially cylindrical overall shape, and the maximum width corresponds to the diameter of the portion.

According to another embodiment of the invention, said at least one groove has a substantially elbowed overall shape with a first groove portion extending in a first direction and a second groove portion extending in a second direction different than the first direction.

The second direction is, for example, substantially perpendicular to the first direction.

The access canal for the crimping electrical contact is, for example, oriented substantially perpendicular to the axis of each groove portion.

The invention may further comprise one or more of the following features considered alone or in combination:

- According to one aspect of the invention, the mounting base comprises at least one blocking portion extending from a wall of the mounting base delimiting a groove toward the inside of the groove.
- Said at least one blocking portion is, for example, formed as an integral part of the base.
- Said at least one blocking portion may be produced by a bent-over section of the wall of the mounting base delimiting a groove at the distal end of the groove distant from the housing for receiving an electrical component.
- According to another aspect of the invention, the mounting base comprises at least one flow guide for the flow of a coat of encapsulant or resin, chosen from a discontinuity at a dividing wall between two grooves and/or at least one notch made on an edge of at least one groove and/or a difference in level in the bottom of at least one groove.
- According to another aspect, the housing is a through-housing.
- According to another aspect, the mounting base comprises a peripheral edge partially covering the groove.
- The base for example comprises at least two grooves extending at least partially in parallel. The mounting base may comprise at least two grooves extending longitudinally in parallel. As an alternative, the mounting base may comprise two grooves each one having a least a first portion and a second portion extending in two different directions and in which the first portions or the second portions of the two grooves extend in parallel.

The invention also relates to a module comprising a mounting base as defined hereinabove, an electrical component equipped with at least two crimping electrical contacts and electrical wires connected to the electrical component by crimping.

The invention relates in particular to a lighting module comprising a mounting base as defined hereinabove and a light emitting diode by way of electrical component, the light emitting diode being equipped with at least two crimping electrical contacts.

The module or the lighting module may further comprise one or more of the following features considered alone or in combination:

According to one aspect, at least two grooves are made on the rear face of the mounting base.

According to another aspect the housing for the light emitting diode has, on the front face of the mounting base, a flared shape encouraging said light emitting diode to emit a cone of light.

The module for example comprises a coat of transparent resin, preferably a domed coat, covering the electrical component such as the light emitting diode.

The module for example comprises a coat of encapsulant or resin covering the rear face of the mounting base.

According to yet another aspect, an electrical wire is connected by crimping to each crimping electrical contact of the light emitting diode.

The general module or the lighting module has the overall shape of a pellet or button.

The invention further relates to a method for producing a module as defined hereinabove, characterized in that:

an electrical wire is passed into each groove, an electrical component such as, for example, a light emitting diode equipped with at least two crimping contacts with crimping spikes facing toward the associated grooves is inserted via the rear face of the mounting base so that on insertion, crimping onto the electrical wires is performed.

Depending on the application a resin, notably a transparent resin, is poured over the front face of the mounting base.

The invention also relates to a method for mounting a module as defined hereinabove on a support, such as a fabric, notably a garment, characterized in that:

an assembly roundel is positioned on the support intended to receive said module, the lighting module is positioned in such a way as to sandwich the support between the assembly roundel and the lighting module, and the lighting module and the assembly roundel are fixed together for example using ultrasonic welding.

According to one aspect of the invention, the support intended to receive the module such as lighting module is sandwiched between the assembly roundel and the front face of said module.

According to another aspect of the invention, the front face of the mounting base of said module is able to project at least partially in relation to the support by passing through corresponding holes made in the support and the assembly roundel.

The invention also relates to a garment (for example a scarf, a vest, an anorak, trousers, a pullover, an item of footwear, a hat or a helmet or even a belt), characterized in that it comprises at least one module formed of a mounting base as defined hereinabove and of an electrical component equipped with at least two crimping electrical contacts.

Figure 2:
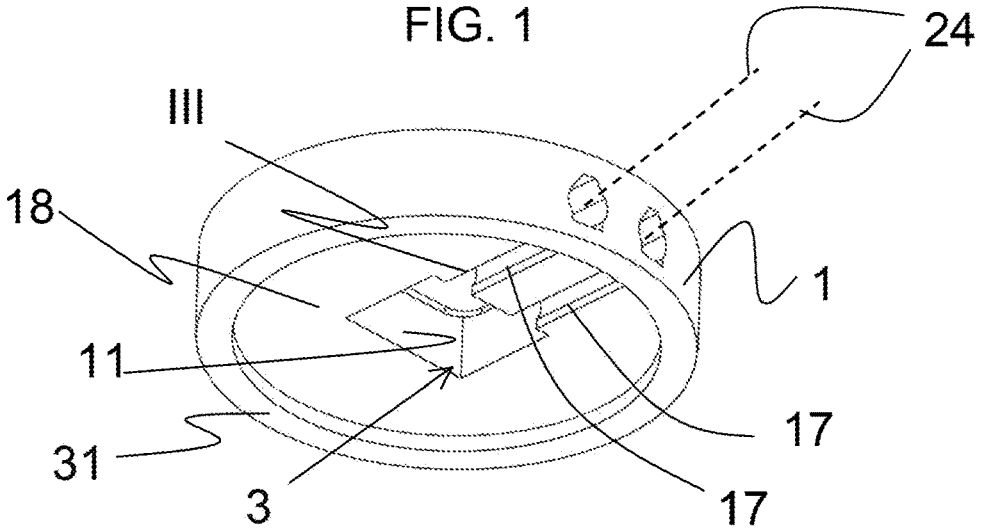
Figure 3:
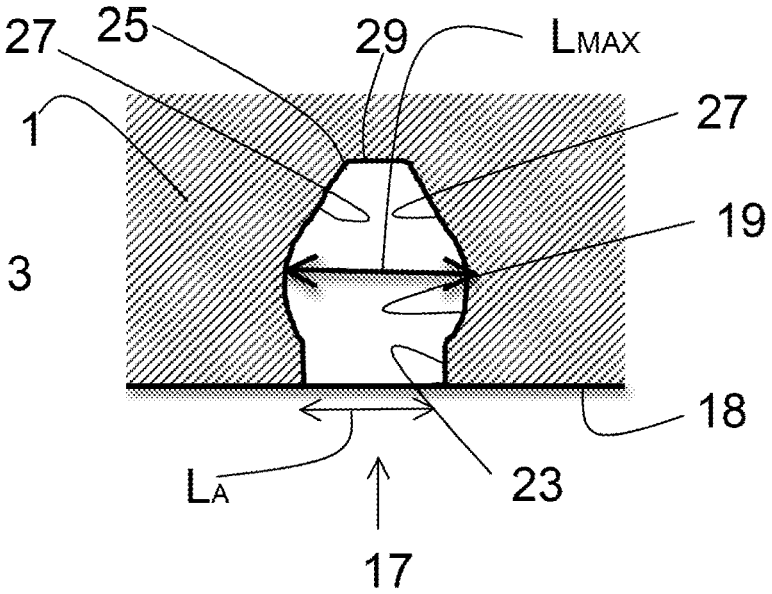
Figure 4:
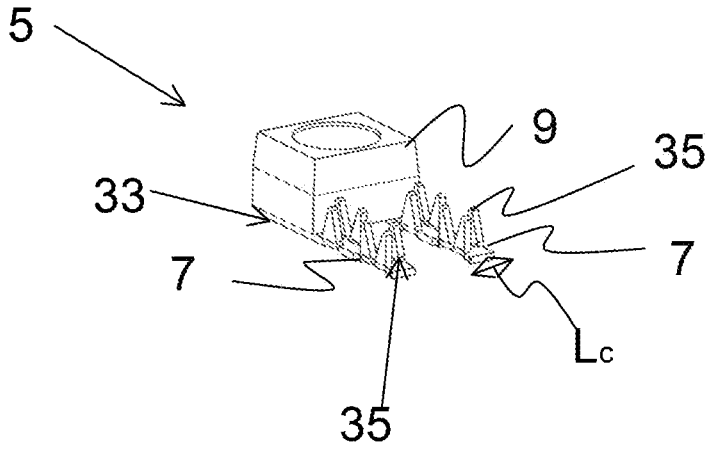
Figure 5:
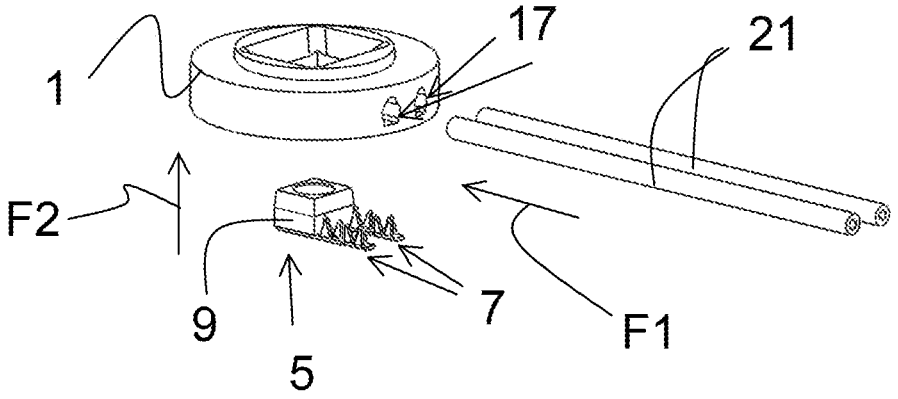
Figure 9:
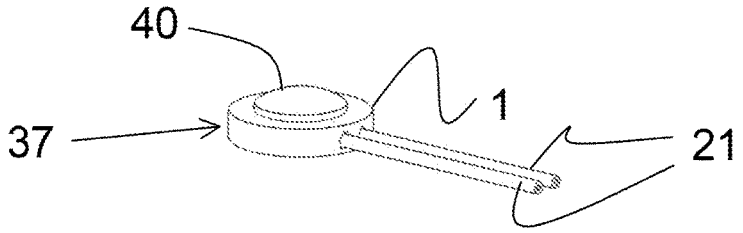
Figure 10:
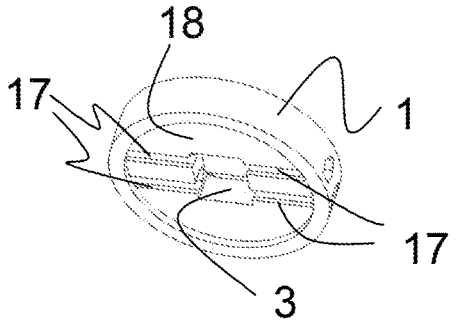
Figure 11:
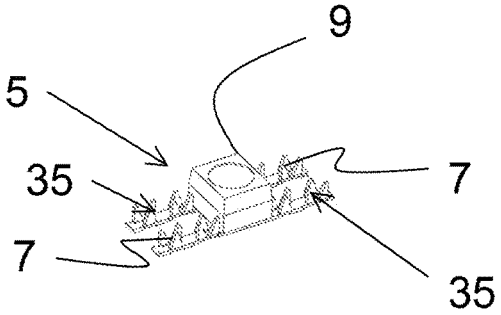
Figure 12:
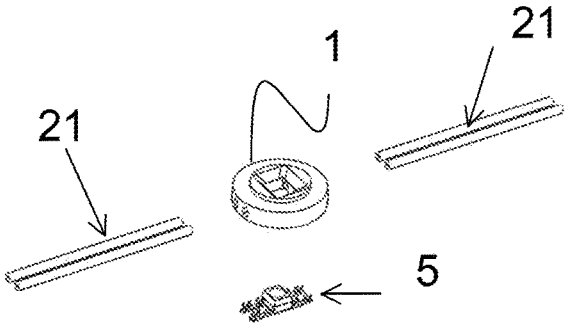
Figure 13:
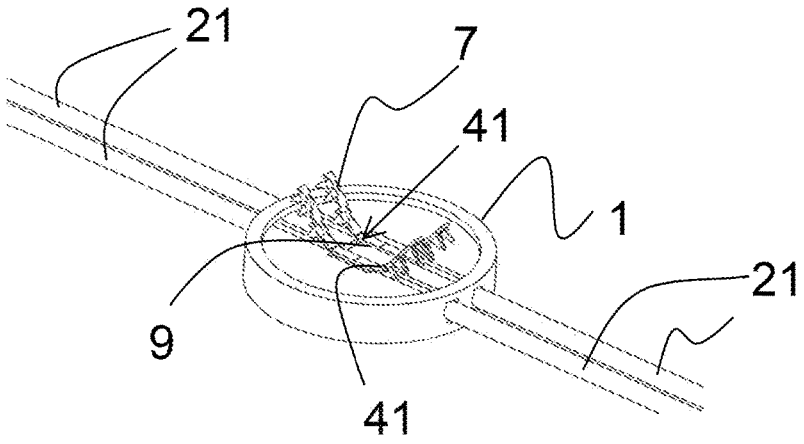
Figure 14:
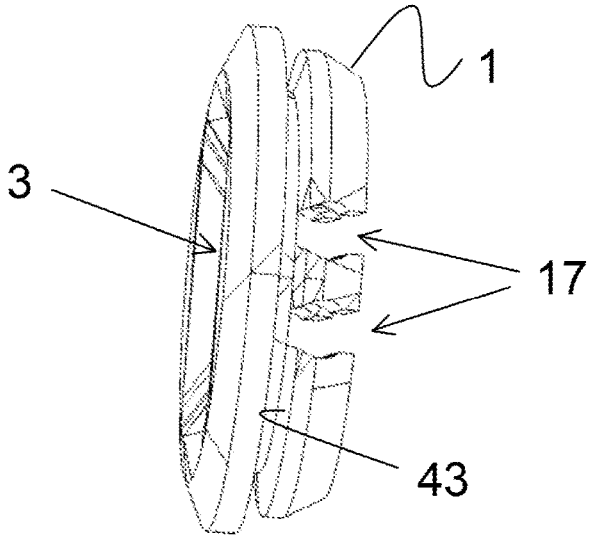
Figure 22:
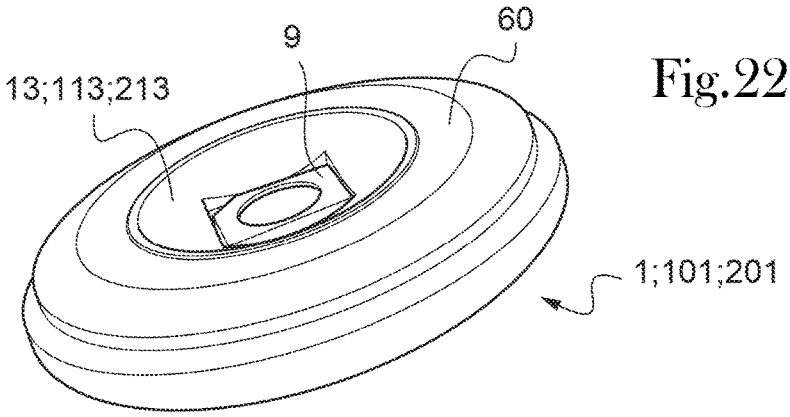
Figure 23:
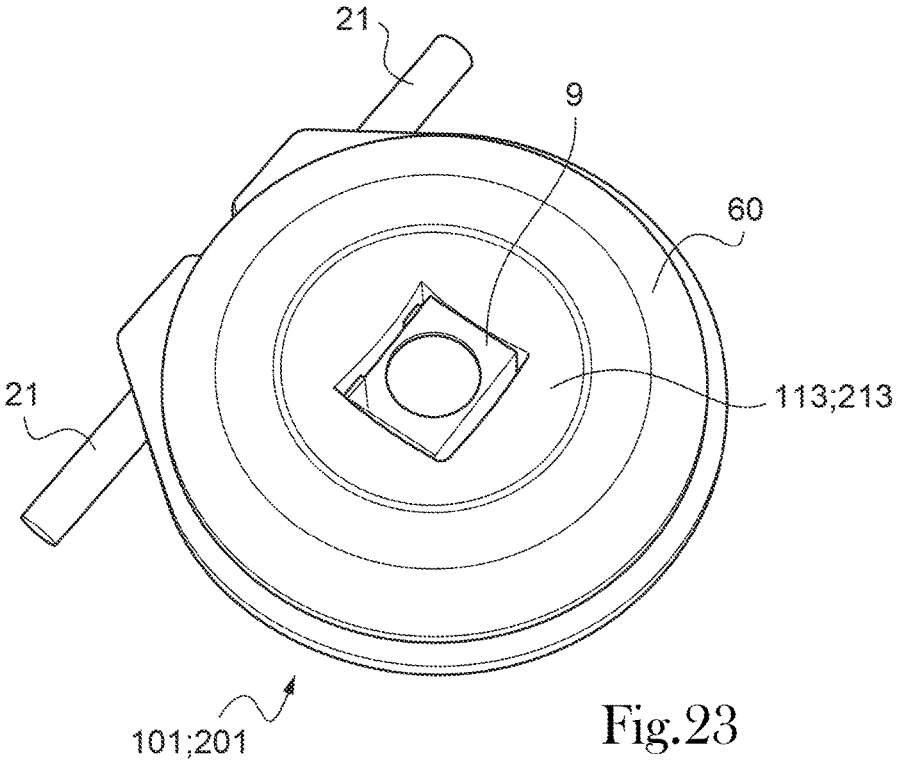

Other features and advantages will become apparent from reading the description of the following figures, among which:

FIG. 1 is a schematic perspective view from above of a mounting base according to a first embodiment of the invention, FIG. 2 is a schematic perspective view from beneath of the mounting base of FIG. 1, FIG. 3 is a view in cross section of detail III of the mounting base of FIGS. 1 and 2, FIG. 4 is a schematic perspective view of an electrical component equipped with crimping electrical contacts, FIG. 5 is an exploded schematic perspective view of a lighting module comprising the mounting base according to the first embodiment of FIGS. 1 and 2 and the electrical component of FIG. 4 prior to assembly, FIG. 6 is a schematic perspective view of the lighting module of FIG. 5 after the electrical wires and the electrical component have been assembled into the mounting base, FIG. 7 is a schematic perspective view from beneath of the lighting module of FIG. 6, FIG. 8 is a schematic view in cross section of detail VIII of FIG. 7, FIG. 9 is a schematic perspective view from above of a lighting module in the assembled state, comprising a resin covering the electrical component, FIG. 10 is a schematic perspective view from beneath of the mounting base according to a second embodiment, FIG. 11 is a schematic perspective view of an electrical component equipped with crimping electrical contacts according to another embodiment, FIG. 12 is an exploded schematic perspective view of a lighting module with the mounting base of FIG. 10 and the electrical component of FIG. 11 prior to assembly, FIG. 13 is a schematic perspective view from beneath of the mounting base bearing an electrical component equipped with crimping electrical contacts according to yet another embodiment, prior to the crimping of the electrical contacts, FIG. 14 is a schematic perspective view from beneath of the mounting base according to yet another, third, embodiment, FIG. 15 is a schematic perspective view from above of a mounting base according to a fourth embodiment of the invention, FIG. 16 is a schematic perspective view from beneath of the mounting base of FIG. 15, FIG. 17 is a schematic perspective side view of the mounting base of FIGS. 15 and 16, FIG. 18 is an exploded schematic perspective view of a lighting module according to the fourth embodiment prior to assembly, FIG. 19 is a schematic perspective view from beneath of the lighting module of FIG. 18 after the electrical wires and the electrical component have been assembled into the mounting base, FIG. 20 is a schematic perspective view from beneath of a mounting base according to a fifth embodiment, FIG. 21 is a schematic perspective view from beneath of a lighting module comprising the mounting base of FIG. 20 after an electrical wire and the electrical component have been assembled into the base FIG. 22 is a schematic perspective view from above of an assembly comprising the lighting module of FIG. 6, 7, 9 or 19 or 21 and an assembly roundel on a support intended to bear the lighting module, and FIG. 23 is a second schematic perspective view from above of an assembly comprising the lighting module of FIG. 19 or 21 and an assembly roundel on a support intended to bear the lighting module.

In all the figures, the same elements bear the same reference numerals. Elements in FIGS. 15 to 19, and respectively 20 and 21, that correspond to the elements of FIGS. 1 to 14 and, respectively, to the elements of FIGS. 1 to 19, bear the same references preceded by a hundreds-figure of 1 and a hundreds-figure of 2, respectively.

The following embodiments are examples. Although the description refers to one or more embodiments, that does not necessarily mean that each reference relates to the same embodiment or that the features apply only to one single embodiment. Simple features from various embodiments may also be combined to provide other embodiments.

FIRST EMBODIMENT

FIGS. 1 and 2 show schematic perspective views from above and beneath respectively of a mounting base 1 for a wired electrical component.

This mounting base 1 has, for example, the shape of a disk or of a pellet, but other shapes are conceivable, for example square or oval, without departing from the scope of the present invention.

The shape of the mounting base 1 is configured to allow the mounting base 1 to be mounted for example on another support, for example a wall, a fabric or a canvas, a rigid or flexible casing, etc. For that purpose, provision may also be made for the mounting base 1 to be equipped with lateral fixing lugs (not depicted), for screwing or bonding of the mounting base 1.

The mounting base 1 is, for example, made of plastic, for example using injection molding.

The mounting base 1 comprises a housing 3 to receive an electrical component 5 equipped with at least one crimping electrical contact 7 (see FIG. 4).

In this exemplary embodiment, the electrical component 5 is, for example, a light emitting diode 9.

In other embodiments, the electrical component may for example be a sensor (a temperature sensor, magnetic and/or electrical field sensor, light sensor/photodiode), a battery, an emitter/receiver, for example an antenna, etc. In general terms, this is an electrical component measuring a few mm across, which needs to be connected to individual electrical wires.

The housing 3 in this particular instance is a through-opening 11, for example square in shape and having, on the front face 13 of the mounting base 1, a shape 15 that flares toward the top (which means to say in a direction substantially parallel to the emission direction of the diode), encouraging the light emitting diode 9 to emit a cone of light when this diode is mounted in the mounting base 1.

In a more sophisticated version, provision may be made for the flared shape 15 to be, for example, metalized, in order to act as a reflector.

What is meant by the front face 13 is that face of the mounting base 1 from which a light emitting diode 9 may emit light when such a diode 9 is mounted in the mounting base 1. The rear/front direction of the mounting base 1 is therefore substantially parallel to the direction of emission of such a light emitting diode 9.

The front face 13 also corresponds to the face of the mounting base 1 that is intended to be at least partially visible when the mounting base 1 is mounted on a support such as a fabric or garment. In particular, this front face 13 is intended to be fixed, for example by bonding, to the support, such as a fabric or garment, in such a way that the part of the front face 13 of the mounting base 1 that has the housing 3 and the flared shape 15 projects with respect to this support, notably by passing through a corresponding hole of complementary shape made in the support intended to receive the mounting base 1.

As an alternative or in addition, this front face 13 may be fixed to an assembly roundel 60 (visible in FIG. 22) for example by ultrasonic welding so as to sandwich the support such as a fabric or garment between this assembly roundel 60 and the mounting base 1. The part of the front face 13 of the mounting base 1 that has the housing 3 and the flared shape 15 in this case is then also able to pass through the corresponding hole of complementary shape in the assembly roundel 60.

As can be better seen in FIG. 2, the mounting base 1 comprises at least one, and in this instance two, grooves 17. The groove or grooves 17 are advantageously formed on the rear face 18 of the mounting base 1. What is meant by the rear face 18 is the opposite face of the mounting base 1 to the front face 13. This rear face 18 is intended no longer to be visible from the outside when the mounting base 1 is mounted on a garment for example.

In general, the mounting base 1 has as many grooves 17 as there are electrical wires to be connected to the electrical component 5.

Each groove 17 has in cross section a particular shape depicted according to one embodiment in FIG. 3.

Thus, the groove 17 in cross section has, on the one hand, a portion 19, for example of substantially cylindrical overall shape, configured to receive an electrical wire 21 (see FIG. 5) and, on the other hand, an access canal or access passage 23 for the crimping electrical contact 7. As may be seen in FIGS. 1 to 3, the access canal 23 in this example is oriented perpendicular to the axis 24 of the groove 17, in this instance the longitudinal axis 24 of the groove 17. The access canal 23 has, in the example illustrated, a width $L_A$ that is smaller than the maximum width $L_{MAX}$ of the portion 19 here of substantially cylindrical overall shape. This maximum width $L_{MAX}$ corresponds in the example illustrated to the diameter of the portion 19.

Thus, when a suitable electrical wire 21 having, for example, a diameter slightly smaller than the width $L_{MAX}$ but greater than the width $L_A$ of the access canal 23 is inserted, it is guided longitudinally along the groove 17 without being able to leave the groove.

The width $L_A$ of the access canal 23 is dimensioned so that it is slightly greater than the width $L_C$ (see FIG. 4) of the crimping electrical contact 7.

In the exemplary embodiment of FIG. 3, the groove 17 has a convergent bottom 25 opposite to the access canal 23. This convergent bottom 25 is made up of two inclined straight slopes 27 which end on a straight bottom 29 parallel to the rear face 18 of the mounting base 1.

This convergent bottom 25 with its inclined slopes 27 acts as a crimping shape when the crimping electrical contact 7 is inserted into the groove 17.

Moreover, the mounting base 1 comprises a peripheral edge 31 partially covering the groove 17. This peripheral edge 31 serves firstly as a retainer to retain the electrical wires 21, notably to prevent them from being pulled out in the direction perpendicular to the rear face 18 of the mounting base 1 and secondly as a retaining edge so that a layer of encapsulant can be poured in after the electrical component 5 has been mounted (this will be explained later on).

FIG. 4 shows a schematic perspective view of the electrical component 5 equipped with at least one and, in this instance with two, crimping electrical contacts 7.

As explained hereinabove, the electrical component 5 is, for example, a light emitting diode 9.

The crimping electrical contacts 7 each comprise a region 33 (visible in FIG. 7) that is flat, for example welded to the power supply terminals of the diode 9 and a part that has crimping spikes 35.

In this example, the two electrical contacts 7 are parallel to one another.

One exemplary embodiment of a way of mounting a module such as a lighting module 37 (see FIG. 9) will now be described with reference with FIGS. 5 to 9.

This lighting module 37 comprises a light emitting diode 9 of FIG. 4 and a mounting base 1 as depicted in FIGS. 1 to 3.

FIG. 5 is an exploded schematic perspective view of a lighting module according to the invention prior to assembling, with the mounting base 1, the light emitting diode 9 equipped with two crimping electrical contacts 7 and two electrical wires 21.

In a first step, an electrical wire 21 is passed into each groove 17 in the direction of the arrow F1.

Next, the diode 9 equipped with its two crimping contacts 7 with the crimping spikes 35 directed toward the associated grooves 17 is inserted via the rear face 18 of the mounting base 1 in the direction of the arrow F2 so that on insertion, crimping onto the electrical wires 21 is achieved.

The mounting base 1 therefore acts both as a support or protective casing for the electrical component 5 and as a crimping counterform in order to make the electrical connection with the electrical wires 21.

During this insertion, the spikes 35 will pierce through the electrical wires 21 in such a way as to establish an electrical contact with the strands of the core 39 (see FIG. 8) of the electrical wires 21, then the spikes 35 will deform inwards as they encounter one of the inclined straight slopes 27. This deformation will also allow firm mechanical retention between the electrical wire 21 on the one hand and the crimping electrical contacts 7 on the other.

FIG. 7 shows the light emitting diode 9 crimped onto the two electrical wires 21.

According to an optional step, a transparent resin 40 is then poured over the front face 13 of the mounting base 1, so as to cover the diode 9 and obtain a domed shape which acts as a lens for the diode 9.

A layer of encapsulant (not visible in the figures) for example is also poured over the rear face 18 of the mounting base 1.

This then yields a lighting module 37 that is sealed and protected against moisture and dust.

FIG. 9 shows the lighting module 37 in the form of a pellet the electrical wires 21 of which can easily be connected now, for example, to a power supply unit (not depicted).

Such a module 37, for example a lighting module, can then be fixed to a support such as a fabric or garment. As stated previously, the module 37 may be fixed by the front face 13 of the mounting base 1 against the support so that at least part of the front face 13 exhibiting the housing 3 passes through a corresponding and complementary hole made in the support.

The mounting base 1 may be attached to the support by bonding the front face 13 to the support.

As an alternative or in addition, in order to fix the mounting base 1 on a support, it is possible to provide an assembly roundel 60 (cf. FIGS. 22 and 23) arranged against the support and the mounting base 1 is then arranged in such a way that the support is sandwiched between the mounting base 1, more specifically the front face 13 of the mounting base 1, and this assembly roundel 60. In this case, the part of the front face 13 that has the housing 3 also passes through a corresponding hole of complementary shape in the assembly roundel 60. The mounting base 1 and the assembly roundel 60 may be fixed by ultrasonic welding.

Of course, the order in which some of the steps described hereinabove are performed could be interchanged.

SECOND EMBODIMENT

FIGS. 10 to 11 show another embodiment of the mounting base and of the light emitting diode 9 which differs from that of FIGS. 1 to 9 and which is particularly advantageous for placing several lighting modules 37 in series because it comprises two pairs of grooves 17 on each side of the housing 3 and because the crimping electrical contacts 7 have crimping spikes on each side of the light emitting diode 9. This second embodiment is well suited for mounting several lighting modules in parallel.

Assembly and mounting in this second embodiment are performed in a similar way to that which was described in relation to the first embodiment.

FIG. 13 shows an alternative form of the light emitting diode 9 with its crimping electrical contacts. By comparison with FIG. 11, the electrical contacts 7 are bent up at the start with fold lines 41, so that on assembly, all that is required is for the diode 9 to be placed in its housing and then for the spikes 35 to be lowered in order to crimp the electrical contacts 7 onto the cables 21.

THIRD EMBODIMENT

FIG. 14 shows yet another alternative form of the mounting base 1 which differs from the first or second embodiment in that the mounting base 1 has a mounting groove 43 on its periphery. This alternative form is, for example, very suitable for mounting a module with a mounting base 1 and an associated electrical component 5, on a fabric in the manner of a button, for example for a signaling garment, such as a vest or a parka or even a signaling scarf or a belt.

FOURTH EMBODIMENT

A fourth embodiment of the mounting base 101 is described with reference to FIGS. 15 to 19. Only differences with respect to the first embodiment described with reference to FIGS. 1 to 9 are detailed hereinbelow.

In a similar way to the first embodiment, the mounting base 101 comprises at least one groove 117, and here two grooves 117, respectively having in cross section a portion 119 able to receive an electrical wire 21 and a convergent bottom 125.

Each groove 117 is delimited here by two opposite walls 116 of the mounting base 101. The shape of a groove 117 differs from the first embodiment notably in that the portion 119 able to receive the electrical wire 21 no longer has a cylindrical overall shape of diameter $L_{MAX}$. According to the example illustrated, substantially planar opposite walls 116 delimit the portion 119. In this example, the portion 119 is of constant width.

The convergent bottom 125 itself, better visible in FIG. 18, acts as a crimping form when the crimping electrical contact 7 is inserted into the groove 117.

In a similar way to the first embodiment, the convergent bottom 125 comprises two inclined straight slopes 127 which terminate in a straight bottom 129 substantially parallel to the rear face 118 of the mounting base 101. The inclined straight slopes 127 are inclined with respect to the straight bottom 129 of the groove 117 and are inclined in such a way as to converge toward one another at the straight bottom 129.

Of course other converging shapes of convergent bottom 125 may be envisioned.

Referring once again to FIG. 16, according to this fourth embodiment, the or each groove 117 is defined with a non-rectilinear shape, for example a substantially elbowed shape. In this case, the or each groove 117 of the mounting base 101 does not extend along a single rectilinear longitudinal axis 24 as described with reference to the first embodiment of FIGS. 1 to 9.

In this example, the or each groove 117 extends along a substantially elbowed axis and substantially has the overall shape of an L. Thus, the or each groove 117 comprises:

- a first portion $\mathbf{117}_1$ near to the housing 103 intended to receive the electrical component 5 extending in a first direction, and
- a second portion $\mathbf{117}_2$ distant from the housing 103 extending in a second direction different than the first direction, for example substantially perpendicular to the first direction.

The intersection or elbowed portion between the first portion $\mathbf{117}_1$ and the second portion $\mathbf{117}_2$ of the groove 117 is advantageously curved.

According to the example illustrated, in which a mounting base 101 comprises two grooves 117, the first portions $\mathbf{117}_1$ of the two grooves 117 extend substantially parallel whereas the second portions $\mathbf{117}_2$ extend in the same direction in opposite senses.

The or each groove 117 therefore has a proximal end $\mathbf{120}_1$ with respect to the housing 103 and a distal end $\mathbf{120}_2$, distant from the housing 103, which is not aligned with the proximal end $\mathbf{120}_1$. The proximal end $\mathbf{120}_1$ is provided at the level of the first portion $\mathbf{117}_1$ whereas the distal end $\mathbf{120}_2$ is provided at the level of the second portion $\mathbf{117}_2$. More specifically in this example, the proximal end $\mathbf{120}_1$ and the distal end $\mathbf{120}_2$ are oriented in two directions substantially perpendicular to one another. The distal end $\mathbf{120}_2$ allows a suitable electric wire 21 to be inserted into the associated groove 117.

Inserting an electrical wire 21 into a groove 117 along such an elbowed axis of the groove 117, as indicated schematically by the arrow F3 in FIG. 18, allows control over the bending of the electrical wire 21 and avoids the risk of damage to the electrical wire 21 in the face of external stresses once a module comprising a mounting base 101 and an associated electrical component 5 has been assembled and/or is in operation.

Finally, according to this fourth embodiment, the or each groove 117 may comprise an access canal 123 or access passage for the crimping electrical contact 7. This access canal 123 allows the crimping electrical contact 7 to be inserted along an axis F2 substantially perpendicular to the axis of the groove 117, more specifically to the axis of the first groove portion $\mathbf{117}_1$ near to the housing 103. More generally, the axis F2 of insertion of the crimping electrical contact 7 is substantially perpendicular to the overall plane defined by the mounting base 101.

Moreover, according to the example illustrated, the access canal 123 does not have a width smaller than the maximum width of the portion 119 able to receive the electrical wire 21.

It might be possible, in an alternative form that has not been illustrated, to envision a narrowing that is the opposite to the convergent bottom 125 of the groove 117, so as to form an access canal smaller in width than the portion 119, making it possible when a suitable electrical wire 21, for example having a diameter slightly smaller than the width of the portion 119 but larger than the width of the narrowing that forms the access canal is inserted, for this wire to be guided in the groove 117 without being able to leave this groove.

Moreover, according to the fourth embodiment illustrated in FIGS. 15 to 19, the mounting base 101 is able to no longer exhibit a peripheral edge 31 as described in the first embodiment with reference to FIG. 2. In such a case, an edge 131' (see FIGS. 16 and 19) is provided around the groove or grooves 117 and the housing 103 in order to receive the electrical component 5 rather than on the periphery of the mounting base 101. The edge 131' extends in relief in relation to the overall plane defined by the mounting base 101, more specifically with respect to the plane defined by the rear face 118 of the mounting base 101. The edge 131' therefore extends over a predefined height substantially perpendicular to the plane defined by the rear face 118 of the mounting base 101.

The thickness of such an edge 131' is defined by the person skilled in the art to suit his purposes. As is best visible in FIGS. 16, 17 and 19, the edge 131' may also form a dividing wall 132 between two grooves 117 of the mounting base 101. In the example illustrated, the dividing wall 132 extends between the first portions $\mathbf{117}_1$ of the grooves 117. It goes without saying that the wall 132 extends in a direction substantially parallel to the grooves 117, here to the first portions $\mathbf{117}_1$ of the grooves 117. The dividing wall 132 is therefore here produced as one piece with the edge 131'. The wall 132 extends in relief in relation to the overall plane defined by the mounting base 101 and more specifically in relation to the plane defined by the rear face 118 of the mounting base 101.

Furthermore, according to the fourth embodiment, the mounting base 101 may have one or more blocking portions 145. This makes it possible to prevent the electrical wire 21 from being pulled out of a groove 117 once mounted. Specifically, the blocking portion or portions is/are able to compress the electrical wire 21 in the associated groove 117.

According to the example illustrated in FIG. 16, the mounting base 101 has a blocking portion 145 at each groove 117. Of course, two blocking portions 145 are conceivable, both at the one same groove 117, for example facing one another.

The or each blocking portion 145 is, for example, as one with the mounting base 101. More specifically, the or each blocking portion 145 is formed as an integral part of the mounting base 101, in this example as an integral part of the edge 131'. With more particular reference to the enlarged part of FIG. 16, a blocking portion 145 is formed here by a folded-over section of a wall 116 at the level of the distal end $\mathbf{120}_2$ of the groove 117. The blocking portion 145 therefore extends from said wall 116 toward the inside of the groove 117. In addition, the blocking portion 145 advantageously extends over a predefined distance allowing it to come into abutment against the electrical wire 21 when the latter is inserted in the associated groove 117, so as to compress the electrical wire 21 between this blocking portion 145 and the wall 116 opposite. The wall 116 opposite may, according to an alternative form that has not been illustrated, exhibit another similar blocking portion 145, and so the electrical wire 21 when inserted would be compressed between two blocking portions 145.

Moreover, such a blocking portion 145 also performs a sealing function, making it possible to limit the potential ingress of liquid such as water.

Of course, provision may be made for the mounting base 101 to have two pairs of grooves 117, in a similar way to the second embodiment described hereinabove.

The mounting base 101 may also receive an electrical component 5 as illustrated in FIGS. 4, 5 or according to the alternative form illustrated in FIG. 11 or even in FIG. 13.

Finally, the mounting base 101 may potentially have a mounting groove in a similar way to the third embodiment.

The method for producing a module 137, such as a lighting module comprising such a mounting base 101 and an electrical component 5 comprising for example a light emitting diode 9, is similar to that of the first embodiment, except that in a first step, by way of nonlimiting example, an electrical wire 21 is passed into each groove 117 in the direction of the arrow F3. Of course, alternatively, the electrical wire 21 could be shaped beforehand to complement the elbowed shape of the groove 117 and be inserted into the groove 117 in the direction of the arrow F2 (namely upward with reference to the layout of FIG. 18). The electrical component 5, in this instance the diode 9, is then inserted for example via the rear face 118 of the mounting base 101 in the direction of the arrow F2. More specifically, the electrical component 5, in this example the diode 9, equipped with its two crimping contacts 7 is inserted with the crimping spikes 35 directed toward the second part of the associated grooves 117 so that on insertion, a crimping onto the electrical wires 21 is achieved.

Likewise, with reference to FIGS. 22 and 23, mounting such a module on a support such as a fabric or garment using an assembly roundel 60 can be done in a similar way to the first embodiment.

FIFTH EMBODIMENT

FIGS. 20 and 21 depict a fifth embodiment of the mounting base 201. Only the differences with respect to the fourth embodiment described with reference to FIGS. 15 to 19 are detailed hereinafter. Elements that are identical are not described again.

As before, the mounting base 201 comprises one or more grooves 217, in this instance two grooves 217. The mounting base 201 further comprises at least one flow guide 247, 249 at the level of at least one groove 217, to make it easier for a layer of encapsulant or resin (not visible in the figures) poured for example on the rear face 218 of the mounting based 201 after the electrical component 5 and the electrical wires 21 have been assembled to spread out even underneath an electrical wire 21 with reference to the layout illustrated in FIG. 21. In order to make FIG. 21 easier to study, just one electrical wire 21 has been depicted.

According to the example illustrated, a flow guide may be produced in the form of a discontinuity 247 between the edge 231' and the wall 232 between two grooves 217. The dimensions of such a discontinuity 247 are defined by the person skilled in the art to suit his purposes. By way of nonlimiting example, this discontinuity 247 is formed here near the intersection, in this instance elbowed intersection, between the first groove portion $\mathbf{217}_1$ and the second groove portion $\mathbf{217}_2$. In other words, in this example, the discontinuity 247 is provided near the change in direction of the grooves 217.

Of course, any other siting of the discontinuity 247 may be envisioned to make it easier for the layer of encapsulant or of resin to flow even underneath an electrical wire 21 when the module 237 comprising the mounting base 201, the electrical component 5 and the electrical wire or wires 21 is assembled.

The discontinuity 247 is advantageously sited at a location where, in the mounted state, the electrical wire 21 is most stable, for example at a point where the crimping is most effective.

As an alternative or in addition, a flow guide may be produced in the form of at least one notch 249 provided on the edge 231' at the level of at least one groove 217. Through the creation of such a notch 249, the width of the groove 117 is increased at this point.

The notch or notches 249 may be formed near the first groove portion $\mathbf{217}_1$ and/or the second groove portion $\mathbf{217}_2$. In the case of several grooves 217, at least one notch 249 may be provided at the level of each groove 217. In particular, the notch or notches 249 may be made on the edge 231' at the level of the two grooves 217 symmetrically, as illustrated in FIGS. 20 and 21.

Of course, any suitable siting of the notch or notches 249 may be envisioned to facilitate the flow of the layer of encapsulant or resin, even underneath an electrical wire 21 when the module 237 comprising the mounting base 201, the electrical component 5 and the electrical wire or wires 21 is in the assembled state.

In addition, in order to ensure that the layer of encapsulant or resin does indeed pass underneath the electrical wire 21 in the assembled state, a difference in height or difference in level at the bottom of the or each groove 217 may be provided. What is meant by "height" is the dimension in the direction in which the edge 231' extends in relief with respect to the rear face 218 of the mounting base 201, namely substantially at right angles to the plane defined by the rear face 218 of the mounting base 201. In the example illustrated in FIG. 20, at least one step 251 is provided for this purpose to establish a difference in level with the bottom of the rest of the associated groove 217. The step 251 is therefore higher than the bottom of the rest of the associated groove 217. In other words, the electrical wire 21 when mounted against this step 251, finds itself raised up off the bottom of the rest of the groove 217.

Thus, this difference in level or height in the bottom of the associated groove 217 makes it possible to guarantee that the layer of encapsulant or resin forms a ring around the electrical wire 21, and therefore does indeed pass underneath the electrical wire 21 with reference to the layout illustrated in FIG. 21.

Similarly, a mounting base 1 according to the first, second or third embodiment with reference to FIGS. 1 to 14 may have a flow guide for example in the form of a discontinuity or notch(es) making it easier for the layer of encapsulant or resin to flow and ensuring better distribution thereof.

Of course, the features of the various embodiments described hereinabove may be combined without departing from the scope of the invention.

Moreover, FIGS. 1 to 23 illustrate a mounting base 1; 101; 201 made as a single piece. Of course, it is conceivable to imagine a mounting base made in more than one part, for example in two parts. These two parts are joined together to form a mounting base as described hereinabove.

It will therefore be appreciated that the mounting base 1, 101 according to one or other of the embodiments described hereinabove allows an electrical component 5 to be connected to individual electrical wires 21 easily and without a special-purpose tool.

The invention claimed is:

1. A mounting base for a wired electrical component comprising:

a housing to receive the electrical component including at least one crimping electrical contact; and at least one groove configured to receive an electrical wire configured to be connected to the electrical component;

wherein the at least one groove includes in cross section: a portion configured to receive an electrical wire, and a convergent bottom acting as a crimping shape when the crimping electrical contact is inserted into the groove.

2. The mounting base as claimed in claim 1, wherein the at least one groove includes an access canal for the crimping electrical contact, the access canal being arranged opposite to the convergent bottom.

3. The mounting base as claimed in claim 2, wherein the access canal is oriented substantially perpendicular to the overall plane defined by the mounting base.

4. The mounting base as claimed in claim 3, wherein the at least one groove extends along a longitudinal axis and includes, in cross section:

the portion configured to receive an electrical wire having a maximum width, the access canal for the crimping electrical contact oriented substantially perpendicular to the axis of the groove and having a width smaller than the maximum width of the portion configured to receive an electrical wire, and the convergent bottom opposite to the access canal.

5. The mounting base as claimed in claim 4, wherein the portion configured to receive an electrical wire is of substantially cylindrical overall shape and the maximum width corresponds to the diameter of the portion.

6. The mounting base as claimed in claim 1, wherein the at least one groove has a substantially elbowed overall shape with a first groove portion extending in a first direction and a second groove portion extending in a second direction different than the first direction.

7. The mounting base as claimed in claim 3, wherein the access canal for the crimping electrical contact is oriented substantially perpendicular to an axis of each of groove portions.

8. The mounting base as claimed in claim 1, further comprising at least one blocking portion extending from a wall of the mounting base delimiting a groove toward inside of the groove.

9. The mounting base as claimed in claim 8, wherein the at least one blocking portion is formed as an integral part of the base.

10. The mounting base as claimed in claim 1, further comprising at least one flow guide for flow of a coat of encapsulant or resin, chosen from a discontinuity at a dividing wall between two grooves and/or at least one notch made on an edge of at least one groove and/or a difference in level in a bottom of at least one groove.

11. The mounting base as claimed in claim 1, wherein the housing is a through-housing.

12. The mounting base as claimed in claim 1, comprising a peripheral edge partially covering the groove.

13. The mounting base as claimed in claim 1, comprising at least two grooves extending at least partially in parallel.

14. A lighting module comprising:

a mounting base as claimed in claim 1, and a light emitting diode as the electrical component, the light emitting diode including at least two crimping electrical contacts.

15. The lighting module as claimed in claim 14, wherein at least two grooves are made on a rear face of the mounting base.

16. The lighting module as claimed in claim 15, wherein the housing for the light emitting diode includes, on a front face of the mounting base, a flared shape encouraging the light emitting diode to emit a cone of light.

17. The lighting module as claimed in claim 14, further comprising a coat of transparent resin, or a domed coat, covering the light emitting diode.

18. The lighting module as claimed in claim 14, further comprising a coat of encapsulant covering a rear face of the mounting base.

19. The lighting module as claimed in claim 14, having an overall shape of a pellet.

20. A method for producing a lighting module as claimed in claim 14, comprising:

passing an electrical wire into each groove, inserting a diode including at least two crimping contacts with crimping spikes facing toward the associated grooves via the rear face of the mounting base so that on insertion, crimping onto the electrical wires is performed;

pouring a transparent resin over a front face of the mounting base.

21. A method for mounting a lighting module as claimed in claim 14 on a support, comprising:

positioning an assembly roundel on the support intended to receive the module;

positioning the lighting module to sandwich the support between the assembly roundel and the lighting module; and fixing together the lighting module and the assembly roundel.

22. A garment, comprising at least one module formed of a mounting base as claimed in claim 1 and an electrical component including at least two crimping electrical contacts.

* * * * *